US011737521B2

(12) United States Patent
Tucker et al.

(10) Patent No.: US 11,737,521 B2
(45) Date of Patent: Aug. 29, 2023

(54) MULTIPLE-UTILITY RELEASE BUCKLE

(71) Applicants: Curt Tucker, Saginaw, MI (US); Jacob Avery, Brighton, MI (US)

(72) Inventors: Curt Tucker, Saginaw, MI (US); Jacob Avery, Brighton, MI (US)

( * ) Notice: Subject to any disclaimer, the term of this patent is extended or adjusted under 35 U.S.C. 154(b) by 0 days.

(21) Appl. No.: 17/930,455

(22) Filed: Sep. 8, 2022

(65) Prior Publication Data

US 2023/0015552 A1 Jan. 19, 2023

Related U.S. Application Data

(63) Continuation of application No. 17/318,443, filed on May 12, 2021, now abandoned.

(51) Int. Cl.
*A44B 11/25* (2006.01)

(52) U.S. Cl.
CPC ..... *A44B 11/2546* (2013.01); *A44B 11/2526* (2013.01)

(58) Field of Classification Search
CPC ..... A44B 11/2546; A44B 11/2526; A44B 11/2542; Y10T 24/45618; Y10T 24/4501; Y10T 24/45084; Y10T 24/45613
See application file for complete search history.

(56) References Cited

U.S. PATENT DOCUMENTS 1,158,827 A 11/1915 Moricet
1,303,652 A 5/1919 Girdler
1,877,354 A 9/1929 Switlik
2,336,558 A 3/1945 Dowd
3,617,019 A * 11/1971 Femia ..... B64D 17/32 24/313
3,747,167 A * 7/1973 Pravaz ..... B64D 17/32 24/579.11
3,832,998 A 9/1974 Gregg
4,099,306 A 7/1978 Matthews et al.
4,367,535 A 1/1983 Barbal
4,656,350 A 4/1987 Tanaka et al.
5,306,044 A 4/1994 Tucker
6,284,427 B1 9/2001 Okazaki et al.
6,390,562 B1 5/2002 Takamizu et al.
6,393,677 B1 5/2002 Anscher
6,678,925 B1 1/2004 Howell
6,796,007 B1 9/2004 Anscher
6,813,782 B2 11/2004 Kintzi et al.
7,065,843 B1 * 6/2006 Wu ..... A44B 11/2542 24/642
9,072,346 B2 * 7/2015 Greaves ..... A44B 11/2542
9,545,133 B1 * 1/2017 Wu ..... A44B 11/2542
2010/0244424 A1 * 9/2010 Kranz ..... A44B 11/2542 280/808
2016/0120269 A1 * 5/2016 Wu ..... A44B 11/2569 24/573.11
2016/0219988 A1 * 8/2016 Huang ..... A44B 11/2542
2017/0164693 A1 * 6/2017 Wu ..... A44B 11/2549

OTHER PUBLICATIONS

US 5,829,573 A, 11/1998, Howell (withdrawn)

* cited by examiner

*Primary Examiner* — Robert Sandy
*Assistant Examiner* — Rowland Do

(57) ABSTRACT

Multiple-utility release buckles used in passive restraint systems for human occupants of vehicles. These types of buckles are typically useful in one embodiment, as a buckle for a safety harness that is commonly used in racing gear, such as automobile racing.

2 Claims, 4 Drawing Sheets

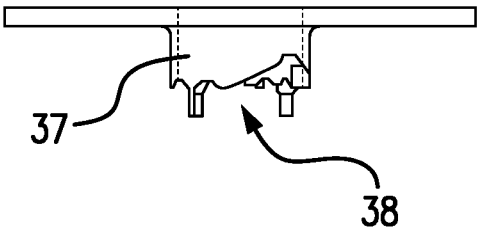
FIG. 2A
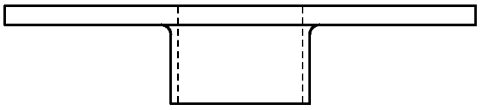
FIG. 2B
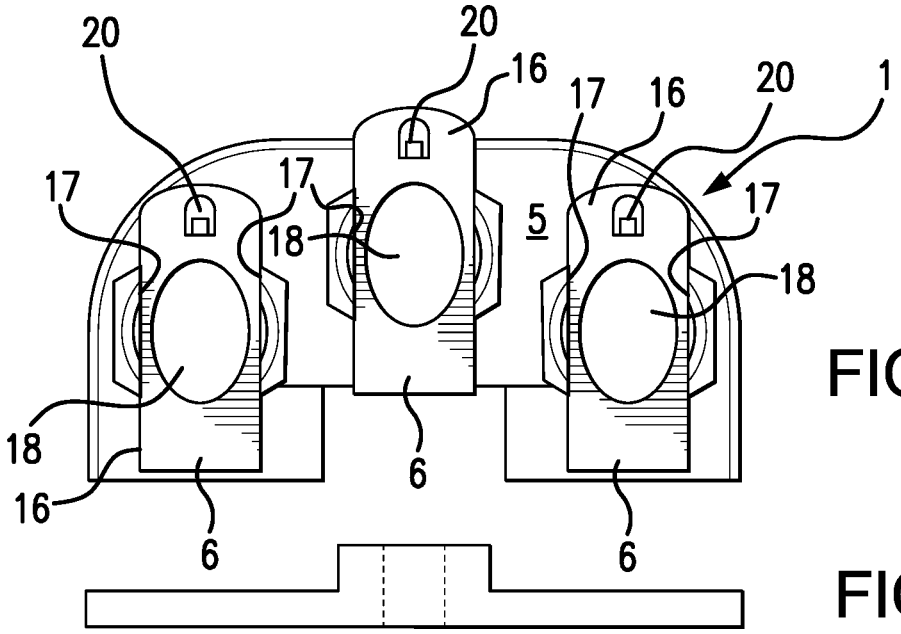
FIG. 3A
FIG. 3B

MULTIPLE-UTILITY RELEASE BUCKLE

CROSS-REFERENCE TO RELATED APPLICATIONS

This application is a continuation utility application of U.S. Ser. No. 17/318,443, filed May 12, 2021 from which priority is claimed.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

This invention deals with multiple-utility release buckles used in passive restraint systems for human occupants of vehicles. These types of buckles are typically useful in one embodiment, as a buckle for a safety harness that is commonly used in racing gear, such as automobile racing.

The belt buckle of this invention is new and novel because it is modified to also contain utility connections, for example, air, water, and a radio connection.

The buckles are strong, reliable, and have a release mechanism that will allow the user to release all of the belts of the racing harness that are connected thereto, at the same time, also release all of the utility connections as the buckles release, and without undue effort. In other words, the buckle connections and utility connections are separable from their connections by the use of one hand of the user, which is a requirement for safety harnesses used in racing.

Many such devices are described in the prior art in the context of harnesses and are of interest, namely, U.S. Pat. No. 1,158,827, that issued on Nov. 2, 1915 to Moricet; U.S. Pat. No. 1,303,652, that issued on May 13, 1919 to Girdler; U.S. Pat. No. 1,877,354, that issued on Sep. 13, 1929 to Switlik; U.S. Pat. No. 2,336,558, that issued on Mar. 27, 1945 to Dowd; U.S. Pat. No. 3,832,998 that issued on Jan. 21, 1975 to Schnurmacher; U.S. Pat. No. 4,367,535 that issued on Jan. 11, 1983 to Barbal; U.S. Pat. No. 4,656,350, that issued on Apr. 14, 1987 to Tanaka, et al.; U.S. Pat. No. 5,306,044 that issued Apr. 26, 1994 to Tucker; U.S. Pat. No. 5,829,573, that issued on Nov. 10, 1998 to Howell; U.S. Pat. No. 6,390,562, that issued on May 21, 2002 to Takamizu, et al.; U.S. Pat. No. 6,393,677, that issued on May 28, 2002 to Anscher; U.S. Pat. No. 6,678,925 that issued Jan. 20, 2004 to Howell; U.S. Pat. No. 6,284,427 that issued on Feb. 3, 2004 to Nishida et al.; U.S. Pat. No. 6,796,007 that issued on Sep. 28, 2004 to Anscher, and U.S. Pat. No. 6,813,782, that issued on Nov. 9, 2004 to Kintzi, et al.

None of the patents of interest have the novel features of the separable buckles of the instant invention.

The most pertinent art appears to be U.S. Pat. No. 4,099,306, which issued Jul. 11, 1978 to Matthews, et al. in which there is shown a separable buckle that is adapted to connect two separable belts. There is a first structural member in the form of a floating link that is typically secured permanently to one end of a first belt. A second structural member is adapted to be permanently secured to the end of the other belt.

Permanently attached to the second structural member is a lever that is pivotable about a control axis near the distal end of the second structural member. The control axis is preferably elevated above the plane defined by the remote ends of the two structural members as an aid to keeping the buckle closed. At an intermediate position along the lever there is provided an open-face cusp that is adapted to receive the distal end of the floating link.

In latching the buckle, the lever is rotated to an extended position, and the distal end of the floating link is rested against the cusp. By rotating the lever through about 180° to a folded condition alongside the second structural member, the floating link is drawn toward the second structural member. By causing the lever to rotate "over-center", the buckle becomes essentially self-latching. Also disclosed by this reference is means for securing auxiliary straps, such as shoulder straps, or leg straps, to the buckle when it is in a latched condition. A good illustration of how the buckle operates can be found in FIGS. 5A to 5C of that reference.

The buckles of the instant invention differ is several significant ways, for example, the release of the buckles of the harness and the connections of the utilities connected to the buckle are released all at the same time. The release mechanism can be operated by just one finger or thumb action. The buckle assembly with the utility connections are small in construction so that they are not bulky.

BRIEF SUMMARY OF THE INVENTION

Thus, what is disclosed in this specification and claims are multiple-utility release buckles that comprise in combination a cam release assembly surmounted by a utility release assembly. The utility release assembly comprises a special retainer pin having a flat head, wherein the special retainer pin is slidably projected through an aperture of a compression plate of the cam release assembly with a head of the special retainer pin located beneath the compression plate.

The cam release assembly is surmounted by a fitting block. The fitting block is secured to the top of the compression plate. There is a release bar in alignment with the top of the special retainer pin.

The fitting block has at least three openings through it. There is a lever attached to and surmounting a cam actuator of the cam release assembly, wherein three of the openings in the fitting block are fitted with utilities selected from the group consisting of air, water, and a radio connection, wherein, each of the utility fittings are fitted with a release mechanism for releasing connections to the utility components through operation of the release bar through operation of the lever on the release assembly.

BRIEF DESCRIPTION OF THE SEVERAL VIEWS OF THE DRAWING(S)

FIG. 2A is a side view of the compression plate of the cam release assembly of FIG. 1A showing the cam configuration.

FIG. 2B is a side view of the compression plate of FIG. 2A.

FIG. 3A is a front view of the fitting block portion of the multiple-utility release buckle.

FIG. 3B is an edge view of a lift plate for the filling block of FIG. 3A.

DETAILED DESCRIPTION OF THE INVENTION AND DRAWINGS

It should be noted that a portion of the cam release assembly of this invention is shown in U.S. Pat. No. 5,306,044, that issued on Apr. 26, 1994, naming Curt Tucker, the inventor herein, as the inventor. That portion has been modified for the instant invention with the fitting block and multiple utility release portion.

Figure 4:
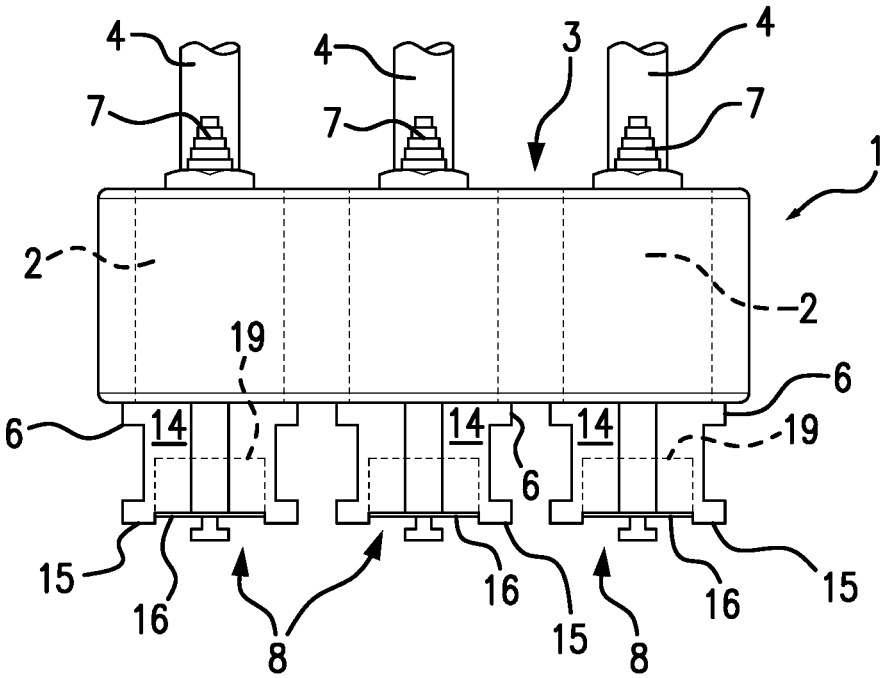
FIG. 4 is a full top view of the fitting block of FIG. 3.

The modification consists of the fitting block and multiple utility release portion which comprises the fitting block 1 which is a unitary block having three openings 2 through it (shown in phantom in FIG. 4). Contained in the openings 2 are fittings 7 for securing tubing 4 thereto (FIG. 4). These tubes 4 are used to convey in one instance air, in another instance water, and in a third instance, a radio connection.

The front 5 (FIG. 3A) of the fitting block 1 also contains fittings 6. The fittings 6 are configured to accept and contain connectors 8 which also contain tubes 9 (FIG. 4) for conveyance of the utility to its useful end.

Figure 5:
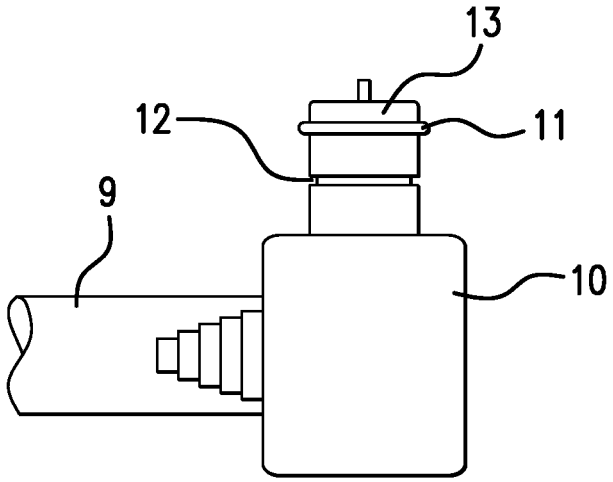
FIG. 5 is a full top view of a front connection valve of the fitting block of FIG. 3.

The fittings 6 are capable of accepting component connectors 10 as shown in FIG. 5. The component connectors 10 have an O-ring 11 and a channel 12 cut into the insertable portion 13 of the component connectors 10 to facilitate holding the component connectors 10 within the connectors 8.

The connectors 8 consist of a plug 14 that is threadedly screwed into the fitting block 1 (FIG. 4). The connectors 8 have a front face 15 and slidably mounted on the front face 15 is a metal plate 16. The metal plate 16 slides in grooves 17 in a vertical motion, up and down. There are openings 18 in the metal plates 16 that are oval in shape in a vertical orientation as shown in FIG. 3A. Positioned at the top of the oval opening 18, in the metal plate 16 is a spring loaded pin 20 that is compressed when the component connectors 10 have been inserted into the oval opening 18 until the channel 12 meets the metal plate 16, at which time, the groove 17 accepts the metal plates 16 and locks the component connectors 10 into place.

The metal plates 16 have a flat plate 19 (shown in phantom in FIG. 4) at the bottom end of the metal plate 16 that are located horizontally to the metal plate 16. This flat plate 19 is a compression point for the metal plates 16 that raises the metal plates 16 that release the component connectors 10. This is accomplished by the raising of the metal plates 16 from the spring-loaded pins 20 which allow the spring-loaded pins 20 to be pushed by their springs outwardly. This operation causes the metal plates 16 to drop and allow the component connectors 10 to be released.

Figure 1A:
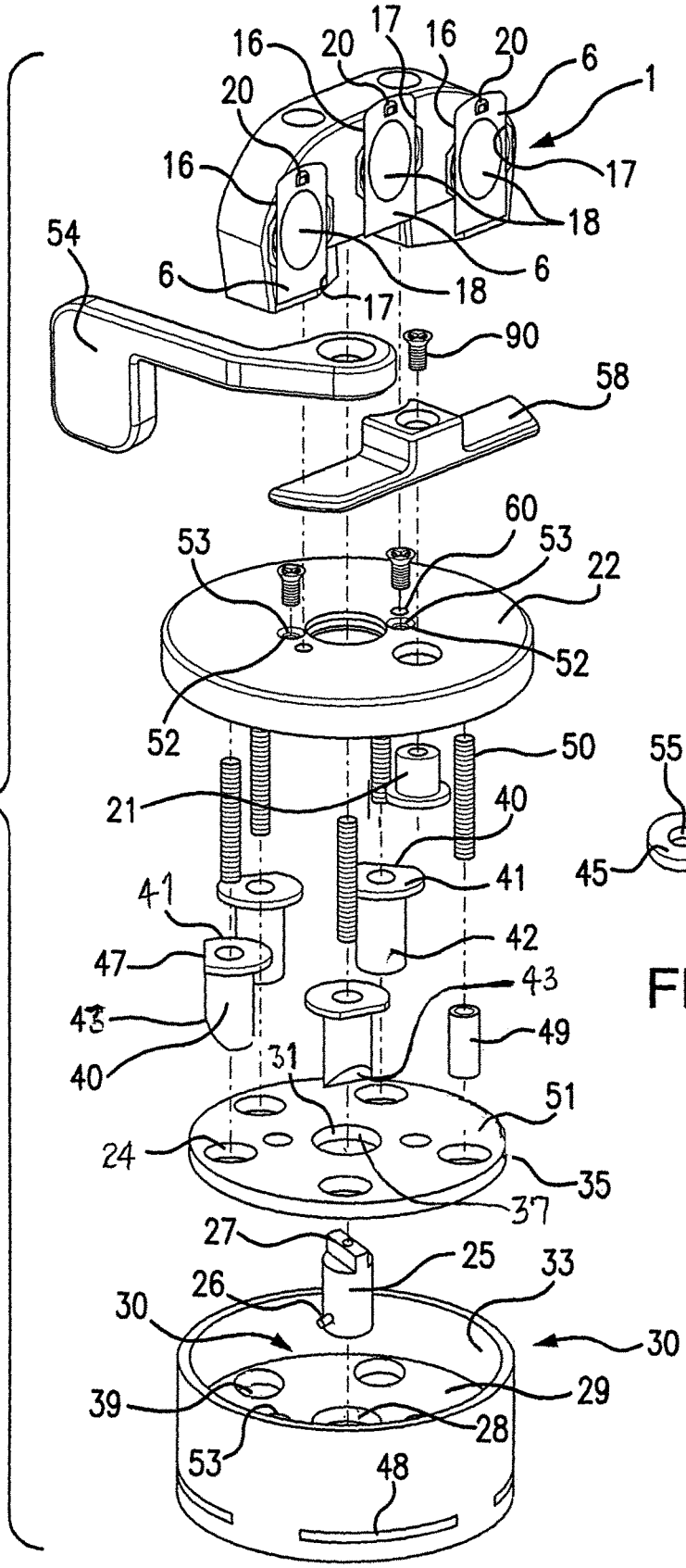
FIG. 1A is an exploded view of the cam release assembly portion of the multiple-utility release buckle.

The raising of the metal plates 16 is accomplished through a spring-loaded pin 20 (FIGS. 1A, 3A and 4).

It is best at this point to describe the cam release assembly in detail. With reference to FIG. 1A, there is shown an exploded view of a cam release assembly P comprising a cylindrical cam actuator 25 with a cam follower 26 and a drive lug 27 is journaled in a bore 28 in the center of the bottom wall 29. The bore 28 does not pass all the way through the bottom wall 29. The cylindrical cam actuator 25 projects up through the cam plate 51, through a large aperture 31 in the center of the cam plate 51 and the interior wall 33 and through the center of the cam plate chamber. The cam plate 51 includes a disc member 35 and an internal tube 37 that projects from one side of the center of the disk member 35. The tube 37 has a free end with a cam 38 (see FIG. 2A). The cam plate 51 is positioned in the cam plate chamber 30 with the internal tube 37 projecting into and journaled in the bore 28. The cam follower 26 on the cam actuator 25 is adjacent to the cam 38 and the cam actuator 25 is also journaled in tube 37. The cam plate 51 is normally in contact with the surface of the interior wall 33 that is a wall of the compression plate chamber 30.

Figure 1B:
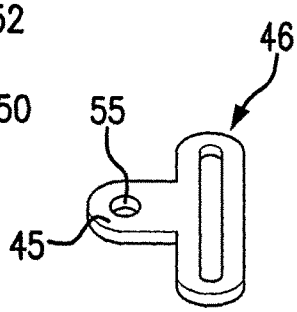
FIG. 1B is a top view of a buckle for use in the cam release assembly.

Retainer pin apertures 24 in the cam plate 51 are in alignment with the bottom retainer pin apertures 39 in the bottom of the compression plate chamber 30. Retainer pins 40 with head portions 41 and shank portions 42 each have their shank portions inserted through retainer pin apertures 24 in the cam plate 35 and through an aligned retainer pin aperture 39. The shank portions 42 extend all the way across the cam plate chamber 30 and into contact with the bottom wall 29. A cam surface 43 is provided on the side of each shank portion 42 for contact by the tongue 45 of a strap lug 46 and to allow the retainer pins 40 to be cammed up out of the cam plate chamber 30 (FIG. 1B).

The head portion 41 of each retainer pin 40 is enlarged so that it cannot pass through the retainer pin aperture 24 in the cam plate 51. A surface 47 on the head portion 41 is adjacent to an inside wall surface of the tubular wall 33 of the tubular body 30 and can contact the interior wall surface 32 to prevent rotation of the retainer pins 40 and to keep the cam surface 43 facing towards an adjacent strap lug aperture 48. Rotation of the cam actuator 25 will move the cam follower 26 into contact with the cam surface 43 and raise the cam plate 51. When the cam plate 51 is moved away from the interior wall 32, the upper surface of the cam plate contacts the head portion 41 of each retainer pin 40 and lifts the shank portion 42 out of the compression plate chamber 30. A special retainer pin 49, without a head portion 41, is used in one of the retainer pin apertures 24. When the cam plate 51 is moved away from the interior wall 32, it does not cam the special retainer pin 49 out of the compression plate chamber 30.

A coil compression retainer pin spring 50 is provided to bias the shank portion 42 of each retainer pin 40 toward the cam plate chamber 51 and the bottom wall 29. A compression plate 22 closes the open end of the cam plate chamber 30, holds the retainer pin spring 50 in position and provides a spring preload. The compression plate 22 is secured to the tubular body 30 by screws that pass through holes 52 in the cam plate 22 and screw into threaded bores 53 in the interior wall 32. A hand lever 54 is mounted to the drive 27 and the portion of the cam actuator 25 that extends through the cam plate 51, by a screw 90.

During operation of the cam release assembly 12, a tongue 45 of a strap lug 46 is inserted into one of the strap lug apertures 48. The tongue 45 contacts the cam 25 by the retainer pin 26, cams the retainer pin up out of the chamber 30, and compresses the retainer pin spring. Once the retainer pin is forced up into the compression plate chamber 30, the tongue 45 of the strap lug 46 slides on into the compression plate chamber 30. Upon contact with the strap plug stop ring movement of the strap lug 46 in the tubular body 30 is stopped, the aperture 55 in the tongue 45 is aligned with a retainer pin and the retainer pin spring drives the retainer pin through the aperture in the tongue 45. The strap lug 46 is then held in the strap lug aperture 48 until the retainer pin is lifted out of the compression plate chamber 30 by the cam plate 51 upon rotation of the hand lever 54, the cam actuator 25 and the cam follower 26. The cam plate 51 will lift all the retainer pins at one time and release all the strap lugs 46 inserted into the strap lug apertures 48 at one time except the strap lug that is held into the cam release assembly 12 by the special retainer pin 49. The purpose of the special retainer pin 49 is to keep the cam release assembly connected to one strap. Simultaneously, the special retainer pin 49 is projected through aperture 60 to raise release bar 58 and thus press the release bar 58 up to the metal plates 19 (FIG. 4) which lifts the metal plates 16, which releases the connectors 10, thereby freeing the connectors 10 from the fittings 6.

Figure 6:
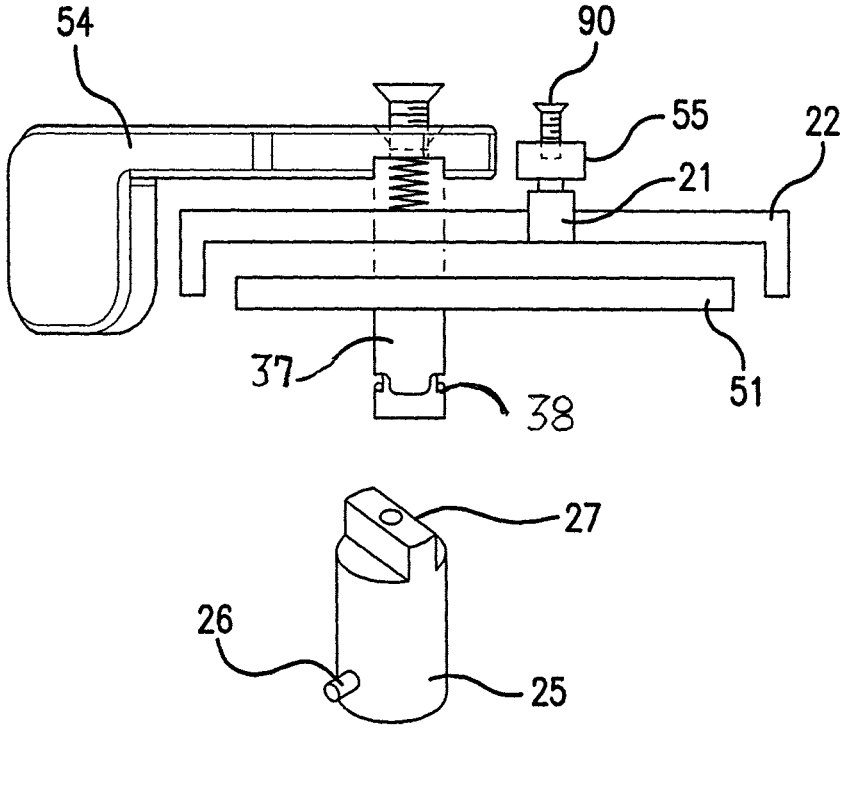
FIG. 6 is a detailed construction in an exploded view, of the cam release assembly.

Turning now to FIG. 6, there is shown an exploded view of the cam operation assembly. There is the compression plate 51, the tube 37, the cam configuration 38, along with the handle (lever) 54.

What is claimed is:

1. A multiple-utility release buckle comprising:

A. a cam release assembly surmounted by

B. a utility release assembly, said utility release assembly comprising:

i. a special retainer pin, said special retainer pin slidably projecting through an aperture of a compression plate of said cam release assembly with said head beneath said compression plate;

ii. said cam release assembly being surmounted by a fitting block, said fitting block being secured to a top of said compression plate;

iii. a release bar surmounted on a top of said special retainer pin;

iv. said fitting block having at least three openings therethrough;

v. a lever, attached to, and surmounting a cam actuator of said cam release assembly;

vi. wherein at least three said openings in said fitting block are fitted with attachment plugs for utilities selected from the group consisting of:

a. air, b. water, c. a radio connection, and wherein, each of said attachment plugs are fitted with a release mechanism for releasing connections to said attachment plugs through operation of said release bar through operation of said lever on said cam release assembly, wherein strap lugs being held in strap lug apertures until said retainer pins are lifted out of said compression plate chamber by said cam plate upon rotation of said hand lever, said cam actuator, and said cam follower, said cam plate lifting all said retainer pins at one time and releasing all said strap lugs inserted into said strap lug apertures, at one time.

2. A multiple-utility release buckle as claimed in claim 1, wherein said openings in said fitting block are fitted with air, water, and a radio connection.

* * * * *